US005329432A

United States Patent [19]

Bland

[11] Patent Number: 5,329,432

[45] Date of Patent: Jul. 12, 1994

[54] LUMINAIRE-PROVIDED FOOTWEAR

[76] Inventor: Todd A. Bland, 4301 Abbott Rd., Lincoln, Nebr. 68516

[21] Appl. No.: 38,894

[22] Filed: Mar. 29, 1993

[51] Int. Cl.[5] ..... A43B 23/26; F21L 15/08

[52] U.S. Cl. ..... 362/103; 36/137

[58] Field of Search ..... 362/103; 36/137, 136, 36/132, 54

[56] References Cited

U.S. PATENT DOCUMENTS

| | | | |
|---|---|---|---|
| 2,931,893 | 4/1960 | Arias et al. | 362/103 |
| 3,008,038 | 11/1961 | Dickens et al. | 362/103 |
| 3,067,322 | 12/1962 | Sala | 362/103 |
| 4,630,383 | 12/1986 | Gamm | 36/54 |
| 5,159,768 | 11/1992 | Longo, Jr. | 36/54 |

*Primary Examiner*—Ira S. Lazarus

*Assistant Examiner*—L. Heyman

[57] ABSTRACT

Athletes' shoes, or other selectable footwear conventionally having a flexible forward tongue, is modified into a tongue forward-fold provided with a horizontal aperture and in forward alignment with the incandescent lamp portion of a luminaire system so that such lamp might beam directionally forwardly from the tongue of the worn footwear. The directionally forward light beam is not only aesthetically attractive, but also can illuminate the directionally forward pathway being taken by the wearer. In preferred embodiments, the luminaire system is a unifiabie incandescent lamp and storage battery power source therefor, and with such unit being securely and replaceably positioned immediately behind the tongue forward-fold.

3 Claims, 2 Drawing Sheets

LUMINAIRE-PROVIDED FOOTWEAR

BACKGROUND OF THE INVENTION

Primarily for aesthetic reasons, the prior art describes luminaire-provided footwear, but such prior art footwear is neither intended nor designed for adequately illuminating the directionally forward pathway taken by night-time walkers and joggers. In the prior art, the footwear luminaire systems tend to be cumbersomely located, uncomfortable to the wearer, and/or are difficult to repair or replace once the incandescent lamp or power source therefor wears-out or misfunctions.

GENERAL OBJECTIVE OF THE INVENTION

It is the general objective of the present invention to provide luminaire-provided footwear that has the capability for adequately illuminating the directionally forward pathway being taken by nocturnally walking and running persons so as to alert them of perils that might exist along their intended pathways.

It is another objective to provide luminaire-provided footwear possessing luminescent: aesthetic features not envisioned by prior art workers.

It is another objective to provided luminaire-provided footwear wherein the luminaire system therefor is tidily and inconspicuously located, does not provide physical discomfort to the wearer, and is easy to replace or repair once the incandescent lamp and/or storage battery power source components wear-out or misfunction.

GENERAL STATEMENT OF THE INVENTION

With the above-mentioned objectives in view, and together with other related and ancillary objectives which will become more apparent as this description proceeds, the luminare-provided footwear of the present invention comprises (for environments of athletes' shoes or other selectable footwear conventionally having a flexible tongue portion): modifying the tongue portion to create a tongue forward-fold provided with a horizontal aperture in forward alignment with the incandescent lamp portion of a luminaire system, the luminaire system desireably taking the form of unified lamp and storage battery power source therefor and that are together conveniently actuatable and de-actuatable and also securely and easily replaceably and repairably positioned immediately behind the tongue forward-fold.

BRIEF DESCRIPTION OF THE DRAWING

In the drawing, wherein like characters refer to like parts in the several views, and in which.

DETAILED DESCRIPTION OF THE DRAWING

Figure 1:
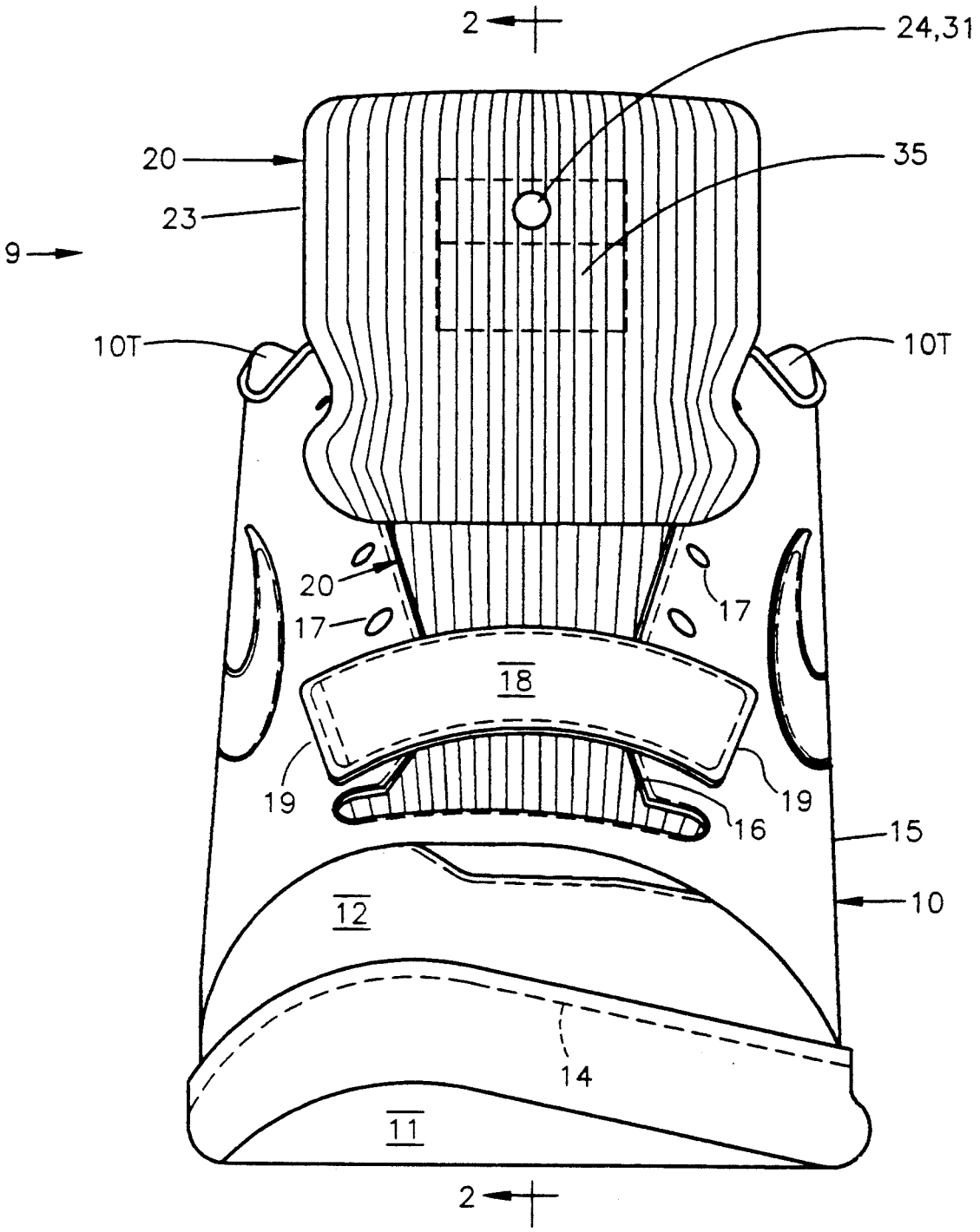
FIG. 1 is a frontal elevational view of a representative embodiment (9) of the luminaire-provided footwear of the present invention.
Figure 2:
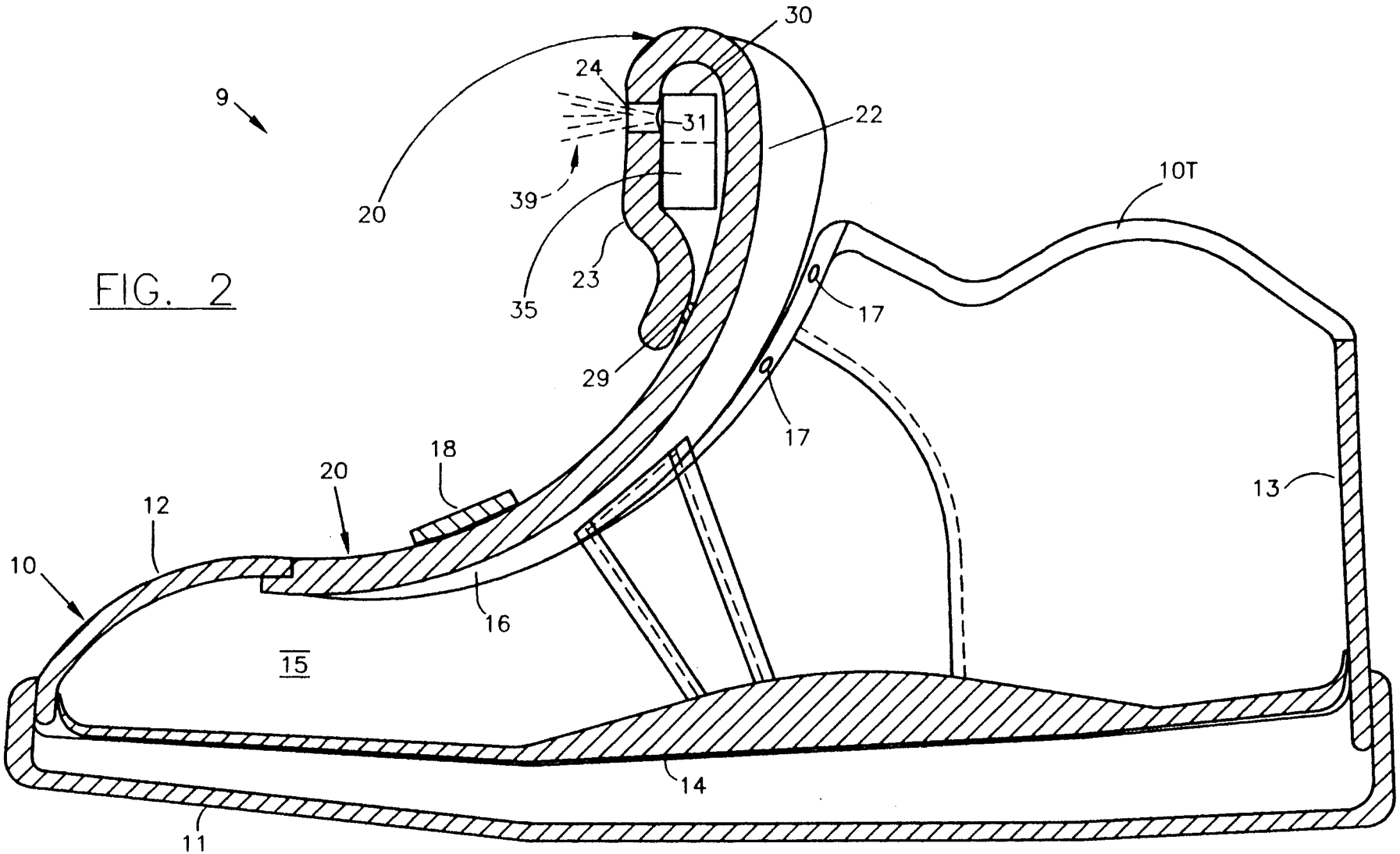
FIG. 2 is a sectional elevational view taken along line 2—2 of FIG. 1.

The luminaire-provided footwear (e.g. 9) of the present invention comprises selectable footwear (e.g. athletic shoe 10) for male and/or female persons provided with a forwardly beaming (39) luminaire system (e.g. 30 ).

Representative footwear 10 typically comprises: a generally horizontal outersole 11 extending between a frontal upright toe 12 and a rearward upright heel counter 13; a generally horizontal innersole 14 overlying outersole 11 and attached to said toe (12) and heel (13) portions; and a hollow vamp 15 attached to and extending upwardly rearwardly from toe portion 12 to terminate at footwear throat 10T overlying a rearward portion of innersole 14. Vamp 15 is topically provided with a centrally-slotted portion 16 therealong and with flanking laceable holes 17. A flexible tongue 20 is forwardly attached (21) to a forward portion of vamp 15 and extends along vamp centrally-slotted portion 16 to a tongue lofty rearward-portion 22 having tongue free-end 25. A strap 18, having its ends 19 permanently and/or removably attached to vamp 15, might overlie a forward portion of tongue 20. Thus, the wearer might insert his/her instep through throat 10T and into vamp 15 between innersole 14 and tongue 20.

In the present invention, the footwear (e.g. 10) carries a luminaire system (e.g. 30) comprising an incandescent lamp portion (e.g. 31) and a chemical storage battery type power source (e.g. 35) therefor. At least the incandescent lamp portion (e.g. 31) is located at the footwear tongue (20) and beams (39) directionally forwardly therefrom.

Herein, the flexible tongue's upward-rearward portion is folded whereby the tongue is thusly provided with an upright forward-fold 23 and tongue free-end 25 is located forwardly of the tongue's loftiest portion. Forward-fold 23 is provided with a horizontally extending aperture, and at least the luminaire system's forwardly beamable incandescent lamp portion (e.g. 31) is in alignment with said forward-fold aperture 24.

Preferably, the luminaire system incandescent bulb (31), the chemical storage battery power source therefor (35), and the on-off-switch therebetween, are unifiably joinable into a single package. Such unifiable package is inserted immediately behind tongue forward-fold 23 and immediately ahead of the tongue's remaining rearward portion, and removably stationed thereat. In the latter regard, tongue forward-fold 23, adjacent tongue free-end 25, can be provided with means (e.g. 29) for removably attaching forward-fold 23 to the tongue's remaining rearward portion. Such means might take the form of adhesive, or alternatively the hooks-and-eyes type (e.g. "Velcro"), mechanical fasteners, etc.

For the luminaire system, conventional Tungsten-filamentary incandescent bulbs might be utilized, and together with conventional carbon-zinc (or equivalent) storage batteries. For especially aesthetic and/or intensively-focused beam standpoints, a laser-type module might be employed as the incandescent bulb portion, and which module can be connected to a conventional carbon-zinc (or equivalent) storage battery power source for the laser lumination means. The battery power source is preferably locatable immediately behind the tongue forward-fold (but alternatively locatable elsewhere on the footwear).

From the foregoing, the construction and operation of the luminaire-provided footwear will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. Footwear for male and/or female persons and conventionally comprising: a generally horizontal outersole extending between a frontal upright toe and a rearward upright heel, a generally horizontal innersole attached to said toe and heel and overlying said outersole, a hollow vamp attached to and extending upwardly from said toe and also extending upwardly rearwardly therefrom to terminate at a footwear throat that overlies a rearward portion of said innersole whereby the wearer's instep might be inserted through said throat and into said vamp, said vamp being topically provided with a centrally-slotted portion therealong, and a flexible tongue attached to a forward portion of and located along said vamp centrally-slotted portion and said tongue having a lofty rearward-portion including a folded portion located adjacent an upper rearward-portion for said tongue, the improvement of:

a frontally beaming luminaire system carried by said footwear and comprising a forwardly beaming incandescent lamp portion carried within said folded portion of said tongue, said folded portion having an aperture therein, said system further comprising within said folded portion a chemical storage power source for said lamp portion of said luminaire system.

2. The luminaire-provided footwear of claim 1 wherein the forward fold of said tongue includes a free end which is positioned forwardly of the remainder of the tongue rearward-portion, said upright forward-fold being provided with a horizontally extending aperture; and wherein at least the incandescent lamp portion of the footwear luminaire system is located immediately rearwardly of said forward-fold and is in a forwardly beaming alignment with said tongue horizontally extending aperture.

3. In footwear conventionally comprising: a generally horizontal outersole extending between a frontal upright toe and a rearward upright heel, a hollow vamp attached to and extending upwardly and rearwardly from said toe to terminate at a rearward upright throat for the footwear, said vamp being typically provided with a centrally-slotted portion therealong, and a flexible tongue attached to a forward portion of and located along said vamp centrally-slotted portion and said tongue having a lofty rearward-portion located adjacent a free-end for said tongue, the improvement of:

(A) said tongue rearward-portion being forwardly folded to provide a tongue forward-fold having: said free-end, means for attaching said tongue forward-fold (adjacent its free-end) to the rearwardly positioned remainder of said tongue, and a horizontal aperture located above said free-end; and (B) a unified luminaire system comprising: an incandescent lamp located immediately behind and in forwardly beamable relationship to said forward-fold apertured portion; and a chemical storage battery power source for said lamp, and said luminaire system being located above said removable attachment means and immediately behind said forward-fold and immediately ahead of the non-foldeed remainder of said flexible tongue.

* * * * *